US010250976B1

(12) United States Patent
Horii et al.

(10) Patent No.: US 10,250,976 B1
(45) Date of Patent: Apr. 2, 2019

(54) ENERGY-EFFICIENT AUDIO LIFE LOGGING

(71) Applicant: INTERNATIONAL BUSINESS MACHINES CORPORATION, Armonk, NY (US)

(72) Inventors: Hiroshi Horii, Tokyo (JP); Toru Nagano, Tokyo (JP)

(73) Assignee: INTERNATIONAL BUSINESS MACHINES CORPORATION, Armonk, NY (US)

( * ) Notice: Subject to any disclaimer, the term of this patent is extended or adjusted under 35 U.S.C. 154(b) by 0 days.

(21) Appl. No.: 15/886,092

(22) Filed: Feb. 1, 2018

(51) Int. Cl.
*H04R 1/40* (2006.01)
*H04R 3/00* (2006.01)

(52) U.S. Cl.
CPC ..... *H04R 3/005* (2013.01); *H04R 1/406* (2013.01)

(58) Field of Classification Search
CPC ..... H04R 3/005; H04R 1/406
See application file for complete search history.

(56) References Cited

U.S. PATENT DOCUMENTS 8,509,923 B2 8/2013 Koskan et al.
2010/0214419 A1* 8/2010 Kaheel ..... H04N 5/272 348/207.1
2013/0012220 A1 1/2013 Waris et al.
2015/0097919 A1* 4/2015 Karimi-Cherkandi ..... H04L 65/80 348/14.07
2015/0188997 A1* 7/2015 Park ..... G06F 1/163 709/201
2016/0180362 A1* 6/2016 Brown ..... G06Q 30/0204 705/7.33
2017/0010658 A1 1/2017 Tanaka et al.

OTHER PUBLICATIONS

Waylon Brunette et al., Open Data Kit Sensors: A Sensor Integration Framework for Android at the Application-Level, MobiSys'12, Jun. 25-29, 2012.
Ming Liu, A Study of Mobile Sensing Using Smartphones, International Journal of Distributed Sensor Networks, Jan. 1, 2013.
Tathagata Das et al., PRISM: Platform for Remote Sensing using Smartphones, MobiSysi'10, Jun. 15-18, 2010.
Felix Xiaozhu Lin et al., Dandelion: A Framework for Transparently Programming Phone-Centered Wireless Body Sensor Applications for Health, Wireless Health'10, Oct. 5-7, 2010.
Xiang Sheng et al., Sensing as a Service: A Cloud Computing System for Mobile Phone Sensing, Sensors 2012 IEEE, Oct. 2012.
Kiran K. Rachuri et al., METIS: Exploring mobile phone sensing offloading for efficiently supporting social sensing applications, 2013 IEEE International Conference on Pervasive Computing and Communications (PerCom), San Diego, CA, Mar. 2013.
Jens Krösche et al., Managing context on a sensor enabled mobile device—the mSense approach, 2009 IEEE International Conference on Wireless and Mobile Computing, Networking and Communications, Oct. 2009.

* cited by examiner

*Primary Examiner* — Sonia L Gay
(74) *Attorney, Agent, or Firm* — Tutunjian & Bitetto, P.C.; Vazken Alexanian

(57) ABSTRACT

Methods and systems for controlling sensors include analyzing streams of sensor data from respective sensors to determine if multiple streams from the plurality of streams share a context. All but one sensor is deactivated associated with the multiple streams to conserve battery power across the sensors.

15 Claims, 8 Drawing Sheets

ENERGY-EFFICIENT AUDIO LIFE LOGGING

BACKGROUND

Technical Field

The present invention generally relates to recording audio in environments with multiple recording devices and, more particularly, to selectively disabling recording in redundant devices to conserve power.

Description of the Related Art

The ubiquity of smartphones and other multifunction mobile devices have made them the platform of chase for audio sensing in contexts such as, e.g., workplace meetings. However, such devices generally are not designed for continuous sensing. As a result, the battery life of such devices can be negatively impacted by their use for context sensing.

SUMMARY

A method for controlling sensors includes analyzing streams of sensor data from respective sensors using a processor to determine if multiple streams from the plurality of streams share a context. All but one sensor is deactivated associated with the multiple streams to conserve battery power across the sensors.

A method for controlling a plurality of sensors includes determining a location of each of a plurality of sensors. It is determined whether each of the plurality of sensors is stationary. A plurality of streams of sensor data from respective sensors is analyzed using a processor to determine if multiple streams from the plurality of streams share a context based on the sensor data, the location of each of the plurality of sensors, and whether each of the plurality of sensors is stationary. All but one sensor associated with the multiple streams is deactivated to conserve battery power across the sensors.

A sensor for controlling sensors includes a context module having a processor configured to analyze a plurality of streams of sensor data from respective sensors using a processor to determine if multiple streams from the plurality of streams share a context. A sensor control module is configured to deactivate all but one sensor associated with the multiple streams to conserve battery power across the sensors.

These and other features and advantages will become apparent from the following detailed description of illustrative embodiments thereof, which is to be read in connection with the accompanying drawings.

BRIEF DESCRIPTION OF THE DRAWINGS

The following description will provide details of preferred embodiments with reference to the following figures wherein.

DETAILED DESCRIPTION

Embodiments of the present invention compare contexts between different recording devices to identify devices that are recording the same context. When this occurs, the present invention disables recording on all but one of the co-located devices, allowing the devices to conserve battery power. Sensing duties may be randomly assigned, may be assigned according to a sensing fidelity, or may be rotated through co-located devices to distribute the battery drain.

It is to be understood in advance that, although this disclosure includes a detailed description of cloud computing, implementation of the teachings recited herein are not limited to a cloud computing environment. Rather, embodiments of the present invention are capable of being implemented in conjunction with any other type of computing environment now known or later developed.

Figure 1:
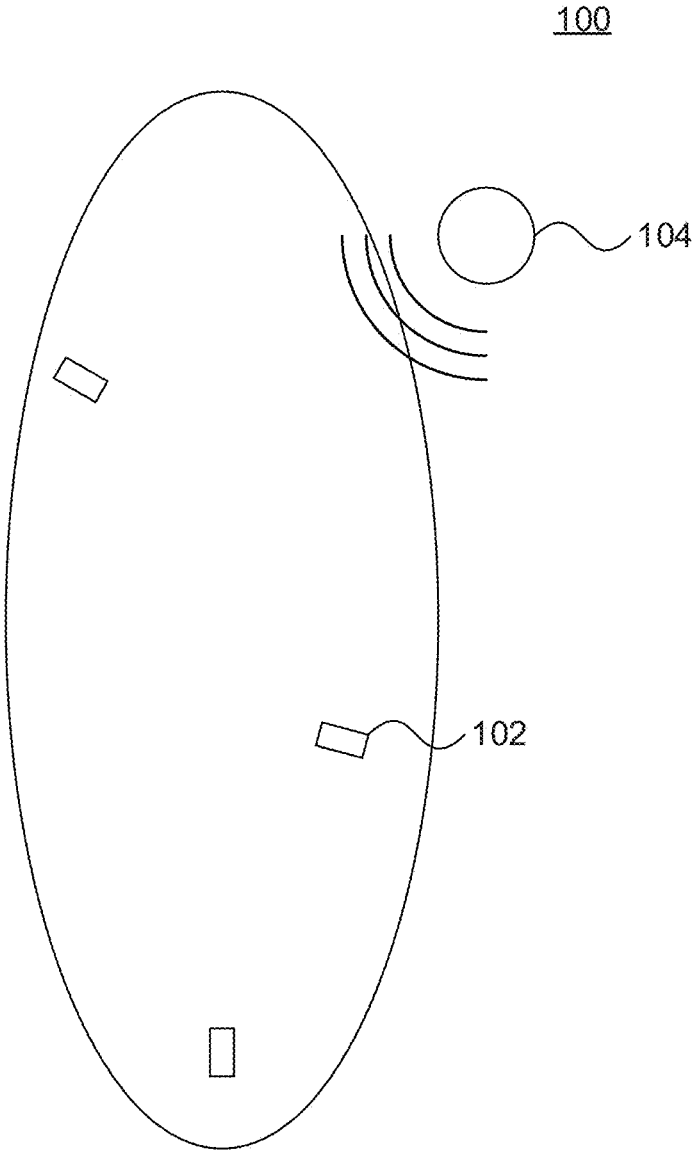
FIG. 1 is a diagram of a shared context in which multiple sensing devices are recording the same sensor information simultaneously in accordance with an embodiment of the present invention.

Referring now to the drawings in which like numerals represent the same or similar elements and initially to FIG. 1, a diagram of an exemplary context 100 is shown. This context 100 pertains to a workplace environment, where a group of people are collected around a table for a meeting. A number of sensing devices 102 are present, all sensing the same audio from a speaker 104. It should be understood that it is specifically contemplated that the sensing devices 102 may be smartphones or other mobile devices or may, alternatively, be fixed sensing devices such as microphones or cameras or a mixture of such devices. Furthermore, although the present embodiments are specifically described with respect to audio sensing, it should be understood that the present principles can also be applied to video recordings and other kinds of sensing, as well as multimedia sensing (e.g., a video camera may record both video and audio information). It should also be understood that the context need not be a meeting or workplace environment but may be any location, public or private, where multiple sensing devices are present.

Figure 2:
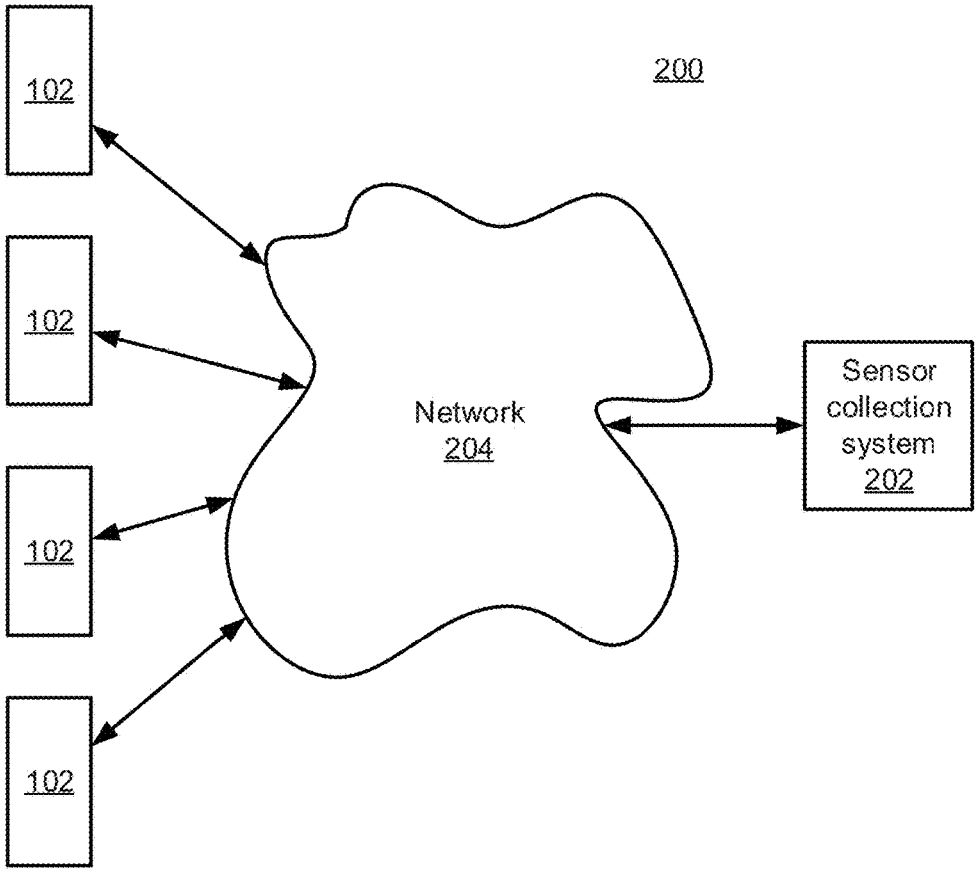
FIG. 2 is a diagram of a sensor collection system that identifies sensing devices within a shared context and selectively deactivates sensing devices to conserve power and reduce redundancy in accordance with an embodiment of the present invention.

Referring now to FIG. 2, a block diagram of a sensing system 200 is shown. The sensing devices 102 are in communication with a sensor collection system 202 via a network 204. It should be understood that the sensing devices 102 may be connected to the network 204 via any appropriate communication medium. In the specific example of smartphones, the sensing devices 102 may be connected via a wireless telephone network and may communicate information as analog audio or as digital data, but it should be understood that any wired or wireless medium and communications protocol may be selected. The sensing devices 102 may be co-located or may be in disparate locations, each communicating to the sensor collection system 202 in a distributed fashion. It should be understood that the sensor collection system 202 may be a single, discrete piece of hardware or may, alternatively, be a distributed or cloud computing system.

The sensing devices 102 may send the sensor data as a continuous stream, in bursts, or in discrete chunks. Initially every sensing device 102 is turned on, such that each sensing device 102 is recording data and sending it to the sensor collection system 202. The sensor collection system 202 performs any appropriate processing function on the received sensor data (e.g., voice recognition) and stores the data if appropriate. The sensing devices 102 may also provide additional information in addition to the recorded sensor data, such as location data (e.g., via a global positioning satellite (GPS) receiver or other location sensing mechanisms), motion data (e.g., via an on-board accelerometer) and device status information (e.g., battery status).

The sensor collection system 202 makes a determination as to whether multiple sensing devices 102 are providing sensor data from the same context. This determination may be based on location data that is sent by the sensing devices 102 and/or by an analysis of the received sensor data to determine that the recorded content is similar.

Based on the determination that multiple sensing devices 102 are located in the same context, such that they are providing redundant sensor information, the sensor collection system 20 provides control instructions to one or more of the co-located sensing devices 102, instructing all but one of those sensing devices 102 to stop recording sensor data and to stop forwarding sensor data to the sensor collection system 202. This has multiple benefits, including at least the reduction of bandwidth consumed by the redundant data streams at the sensor collection system 202, the reduction of power consumption among the disabled sensing devices 102, and a reduction in the amount of storage space and processing power needed at the sensor collection system 202 to handle the redundant information.

At a later time the sensor collection system 202 can re-enable one or more sensing devices 102. This may be performed if, for example, the sensing device 102 that is recording sensor data changes its location, if the battery level of the recording sensing device 102 drops below a threshold, or if a predetermined amount of time has passed. At that time the previously recording sensing device 102 may be disabled (e.g., if another sensing device 102 in the same context has been enabled) or may be left on (e.g., if a sensing device 102 changes position, such that the sensor data streams are no longer redundant).

Figure 3:
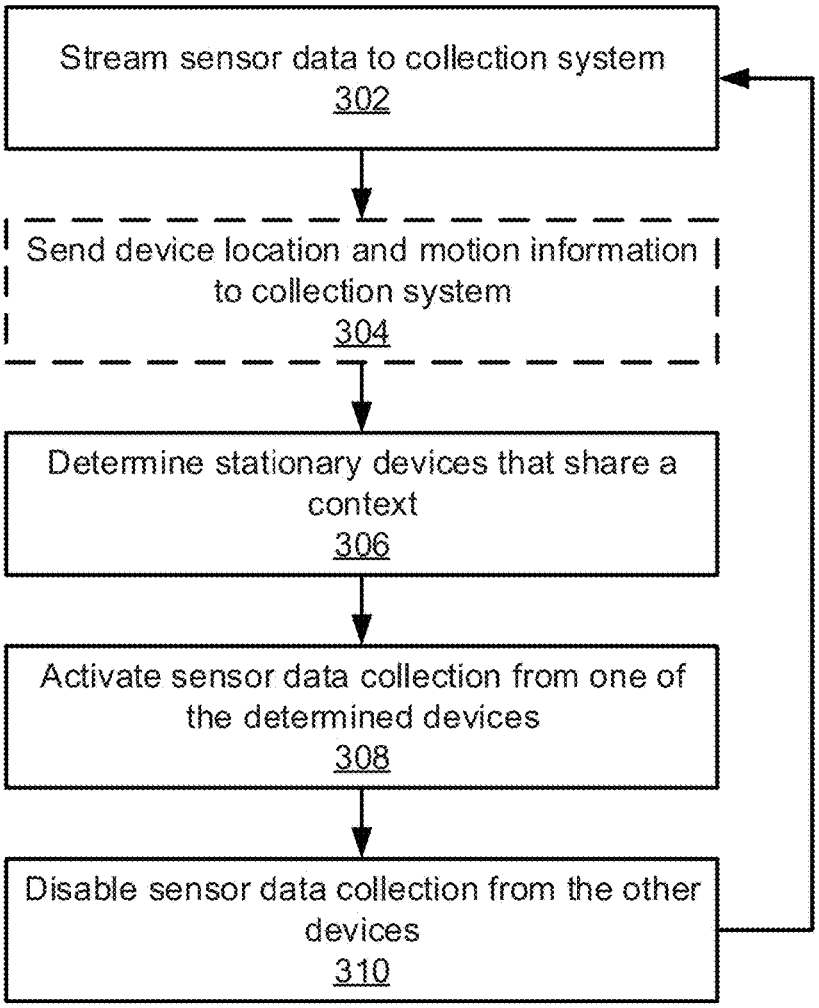
FIG. 3 is a block/flow diagram of a method of managing sensing devices within a shared context in accordance with an embodiment of the present invention.

Referring now to FIG. 3, a method for collecting sensor information is shown. Block 302 streams sensor data from sensing devices 102 to the sensor collection system 202. As noted above, streaming is only one embodiment of the present invention—the collected sensor information can be sent to the sensor collection system 202 in any appropriate manner. Block 304 sends device location and motion information to the collection system 202 as well, though it should be understood that this step is optional and may be omitted in embodiments that focus solely on analysis of the recorded sensor data.

Block 306 determines stationary devices that are in the same context and providing redundant sensor information. This determination can be based on a combination of factors including, for example, the device location information, device motion information, and a direct analysis of the sensor data. For example, block 306 can determine that audio information in the sensor data reflects multiple devices recording the same sounds. In some circumstances, block 306 may determine a number of devices recording the same context and may optionally override a shared context determination if too many devices are providing the same sensor data. For example, if a public announcement in an office building is recorded by many sensing devices 102, this would not indicate a redundant context that should trigger deactivation of sensors. The threshold may be predetermined or may be based on a geographic density of sensing devices 102 according to the device location information.

Block 308 then activates sensor data collection from one of the determined devices and block 310 disables sensor data collection from the other devices sharing the context with the activated device. The activated device may be selected by any appropriate process based on, e.g., random selection, device battery state, recorded noise levels, etc. For example, a device having the highest signal-to-noise ratio, which indicates the greatest clarity in the recorded data, may be activated for continued recording. In other embodiments, a combination of factors may be used. For example, in a context where multiple sensing devices 102 provide streams having roughly equal signal-to-noise ratios (e.g., values falling within a threshold), the sensing device 102 may be selected randomly from among the multiple devices. Processing then returns to block 302 and is repeated.

Repetition of device selection may be triggered by the passage of a predetermined period of time, by a change in device location or positional stability, or by the sensor data diverging (e.g., if a device is covered and no longer reflects a redundant recording). Toward this end, the sensing devices 102 may all be periodically re-enabled to ensure that they continue to record information from the same context.

The present invention may be a system, a method, and/or a computer program product at any possible technical detail level of integration. The computer program product may include a computer readable storage medium (or media) having computer readable program instructions thereon for causing a processor to carry out aspects of the present invention.

The computer readable storage medium can be a tangible device that can retain and store instructions for use by an instruction execution device. The computer readable storage medium may be, for example, but is not limited to, an electronic storage device, a magnetic storage device, an optical storage device, an electromagnetic storage device, a semiconductor storage device, or any suitable combination of the foregoing. A non-exhaustive list of more specific examples of the computer readable storage medium includes the following: a portable computer diskette, a hard disk, a random access memory (RAM), a read-only memory (ROM), an erasable programmable read-only memory (EPROM or Flash memory), a static random access memory (SRAM), a portable compact disc read-only memory (CD-ROM), a digital versatile disk (DVD), a memory stick, a floppy disk, a mechanically encoded device such as punch-cards or raised structures in a groove having instructions recorded thereon, and any suitable combination of the foregoing. A computer readable storage medium, as used herein, is not to be construed as being transitory signals per se, such as radio waves or other freely propagating electromagnetic waves, electromagnetic waves propagating through a waveguide or other transmission media (e.g., light pulses passing through a fiber-optic cable), or electrical signals transmitted through a wire.

Computer readable program instructions described herein can be downloaded to respective computing/processing devices from a computer readable storage medium or to an external computer or external storage device via a network, for example, the Internet, a local area network, a wide area network and/or a wireless network. The network may comprise copper transmission cables, optical transmission fibers, wireless transmission, routers, firewalls, switches, gateway computers and/or edge servers. A network adapter card or network interface in each computing/processing device receives computer readable program instructions from the network and forwards the computer readable program instructions for storage in a computer readable storage medium within the respective computing/processing device.

Computer readable program instructions for carrying out operations of the present invention may be assembler instructions, instruction-set-architecture (ISA) instructions, machine instructions, machine dependent instructions, microcode, firmware instructions, state-setting data, or either source code or object code written in any combination of one or more programming languages, including an object oriented programming language such as SMALLTALK, C++ or the like, and conventional procedural programming languages, such as the "C" programming language or similar programming languages. The computer readable program instructions may execute entirely on the user's computer, partly on the user's computer, as a stand-alone software package, partly on the user's computer and partly on a remote computer or entirely on the remote computer or server. In the latter scenario, the remote computer may be connected to the user's computer through any type of network, including a local area network (LAN) or a wide area network (WAN), or the connection may be made to an external computer (for example, through the Internet using an Internet Service Provider). In some embodiments, electronic circuitry including, for example, programmable logic circuitry, field-programmable gate arrays (FPGA), or programmable logic arrays (PLA) may execute the computer readable program instructions by utilizing state information of the computer readable program instructions to personalize the electronic circuitry, in order to perform aspects of the present invention.

Aspects of the present invention are described herein with reference to flowchart illustrations and/or block diagrams of methods, apparatus (systems), and computer program products according to embodiments of the invention. It will be understood that each block of the flowchart illustrations and/or block diagrams, and combinations of blocks in the flowchart illustrations and/or block diagrams, can be implemented by computer readable program instructions.

These computer readable program instructions may be provided to a processor of a general purpose computer, special purpose computer, or other programmable data processing apparatus to produce a machine, such that the instructions, which execute via the processor of the computer or other programmable data processing apparatus, create means for implementing the functions/acts specified in the flowchart and/or block diagram block or blocks. These computer readable program instructions may also be stored in a computer readable storage medium that can direct a computer, a programmable data processing apparatus, and/or other devices to function in a particular manner, such that the computer readable storage medium having instructions stored therein comprises an article of manufacture including instructions which implement aspects of the function/act specified in the flowchart and/or block diagram block or blocks.

The computer readable program instructions may also be loaded onto a computer, other programmable data processing apparatus, or other device to cause a series of operational steps to be performed on the computer, other programmable apparatus or other device to produce a computer implemented process, such that the instructions which execute on the computer, other programmable apparatus, or other device implement the functions/acts specified in the flowchart and/or block diagram block or blocks.

The flowchart and block diagrams in the Figures illustrate the architecture, functionality, and operation of possible implementations of systems, methods, and computer program products according to various embodiments of the present invention. In this regard, each block in the flowchart or block diagrams may represent a module, segment, or portion of instructions, which comprises one or more executable instructions for implementing the specified logical function(s). In some alternative implementations, the functions noted in the blocks may occur out of the order noted in the figures. For example, two blocks shown in succession may, in fact, be executed substantially concurrently, or the blocks may sometimes be executed in the reverse order, depending upon the functionality involved. It will also be noted that each block of the block diagrams and/or flowchart illustration, and combinations of blocks in the block diagrams and/or flowchart illustration, can be implemented by special purpose hardware-based systems that perform the specified functions or acts or carry out combinations of special purpose hardware and computer instructions.

Reference in the specification to "one embodiment" or "an embodiment" of the present invention, as well as other variations thereof, means that a particular feature, structure, characteristic, and so forth described in connection with the embodiment is included in at least one embodiment of the present invention. Thus, the appearances of the phrase "in one embodiment" or "in an embodiment", as well any other variations, appearing in various places throughout the specification are not necessarily all referring to the same embodiment.

It is to be appreciated that the use of any of the following "/", "and/or", and "at least one of", for example, in the cases of "A/B", "A and/or B" and "at least one of A and B", is intended to encompass the selection of the first listed option (A) only, or the selection of the second listed option (B) only, or the selection of both options (A and B). As a further example, in the cases of "A, B, and/or C" and "at least one of A, B, and C", such phrasing is intended to encompass the selection of the first listed option (A) only, or the selection of the second listed option (B) only, or the selection of the third listed option (C) only, or the selection of the first and the second listed options (A and B) only, or the selection of the first and third listed options (A and C) only, or the selection of the second and third listed options (B and C) only, or the selection of all three options (A and B and C). This may be extended, as readily apparent by one of ordinary skill in this and related arts, for as many items listed.

Figure 4:
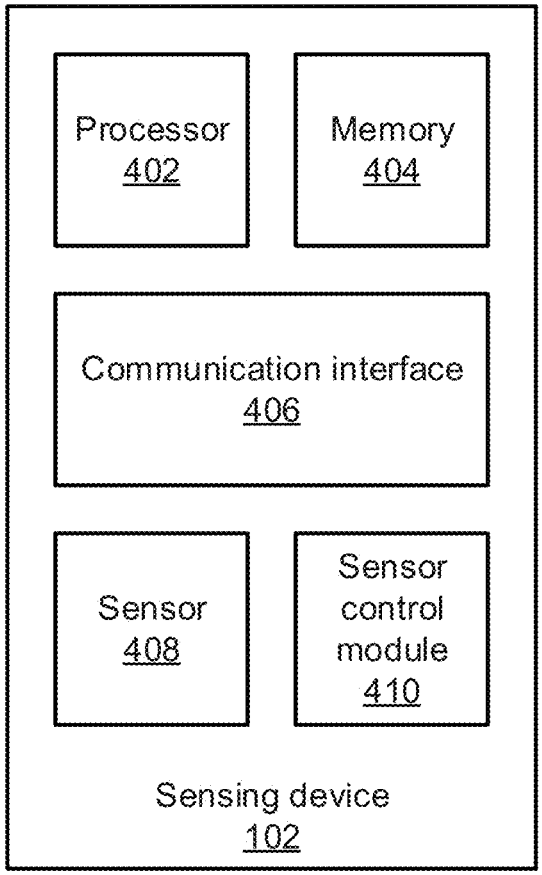
FIG. 4 is a block diagram of a sensing device in accordance with an embodiment of the present invention.

Referring now to FIG. 4, additional detail on a sensing device 102 is provided. The sensing device 102 includes a hardware processor 402 and memory 404. A communication interface 406 provides communications between sensing device 102 and the sensor collection system 202 through the network 204 and may reflect a wired or wireless communication medium using any appropriate communication protocol. The sensing device 102 furthermore includes one or more sensor 408. The sensor 408 may include an audio sensor, a video sensor, a position sensor, an accelerometer, or any or all of the above.

The sensing device 102 furthermore includes a sensor control module 410. The sensor control module 410 may be implemented in some embodiments as software that is stored in memory 404 and that is executed by hardware processor 402. In other embodiments the sensor control module 410 may be implemented as a discrete hardware component that is implemented as, e.g., an application specific integrated chip or a field programmable gate array. The sensor control module 410 receives instructions from the sensor collection system 202 via the communication interface 406 and enables or disables the sensor 408 accordingly.

Figure 5:
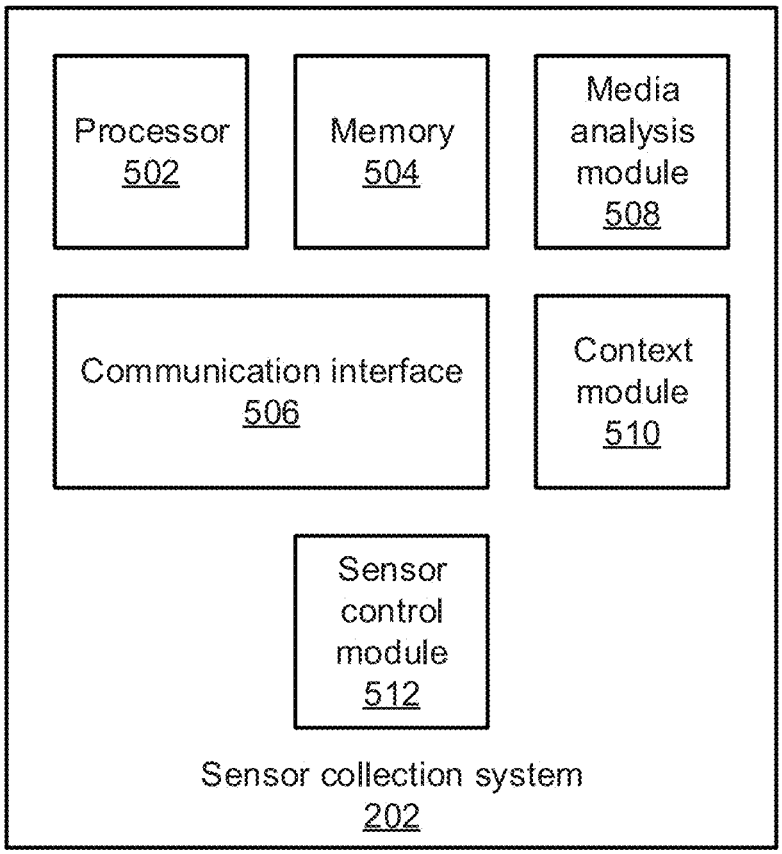
FIG. 5 is a block diagram of a sensor collection system in accordance with an embodiment of the present invention.

Referring now to FIG. 5, additional detail on the sensor collection system 202 is shown. The sensor collection system 202 also includes a hardware processor 502, a memory 504, and a communication interface 506 that communicates with the sensing devices 102 via the network 204. The sensor collection system furthermore includes one or more functional modules that may be implemented as software that is stored in the memory 504 and that is executed by hardware processor 502 or that may, alternatively, be implemented as one or more discrete hardware components in the form of application specific integrated chips or field programmable gate arrays.

The sensor data from the sensing devices 102 is received by the communications interface 506 and is stored in memory 504. Additional information, such as device location and motion information, may also be collected. A context module 510 then determines whether two sensing devices 102 are sending data that reflects a shared context. This can be performed using a combination of device location and an analysis of the recorded data by media analysis module 508. For example, if the device location data indicates that two sensing devices 102 are located near to one another, the media analysis module 508 can determine the contents of the recorded sensor data. The context module 510 then compares the contents of the recorded sensor data for the co-located sensing devices 102 to determine whether they are in the same context (e.g., if they are recording the same events). This can be applied to any form of recorded sensor data including, for example, audio or video information.

Based on the determination by the context module 510 that multiple co-located sensing devices 102 are recording the same context, sensor control module 512 issues commands to the sensing devices 102 using communication interface 506. The commands may include, for example, instructions to disable sensing, instructions to re-enable sensing, queries to provide device information such as location and battery status, etc.

Figure 6:
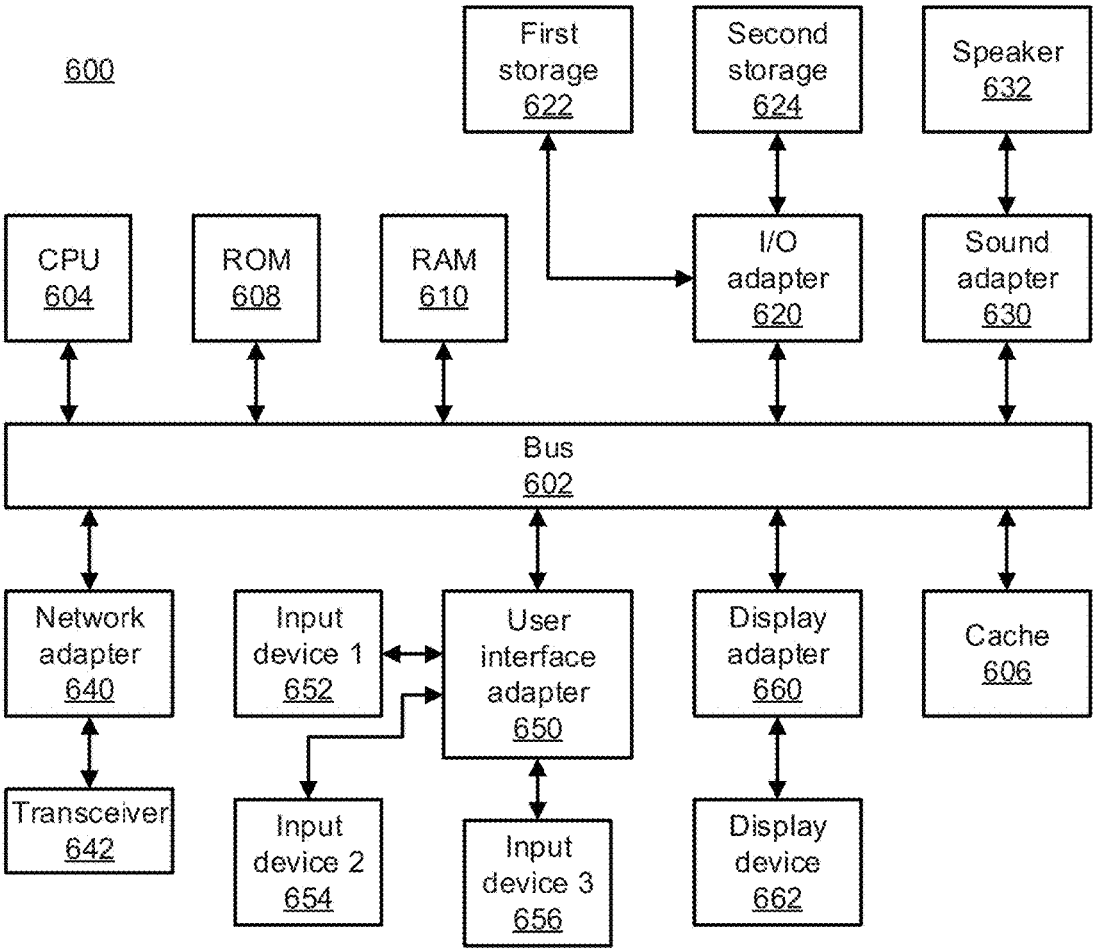
FIG. 6 is a block diagram of a processing system in accordance with an embodiment of the present invention.

Referring now to FIG. 6, an exemplary processing system 600 is shown which may represent the transmitting device 100 or the receiving device 120. The processing system 600 includes at least one processor (CPU) 604 operatively coupled to other components via a system bus 602. A cache 606, a Read Only Memory (ROM) 608, a Random Access Memory (RAM) 610, an input/output (I/O) adapter 620, a sound adapter 630, a network adapter 640, a user interface adapter 650, and a display adapter 660, are operatively coupled to the system bus 602.

A first storage device 622 and a second storage device 624 are operatively coupled to system bus 602 by the I/O adapter 620. The storage devices 622 and 624 can be any of a disk storage device (e.g., a magnetic or optical disk storage device), a solid state magnetic device, and so forth. The storage devices 622 and 624 can be the same type of storage device or different types of storage devices.

A speaker 632 is operatively coupled to system bus 602 by the sound adapter 630. A transceiver 642 is operatively coupled to system bus 602 by network adapter 640. A display device 662 is operatively coupled to system bus 602 by display adapter 660.

A first user input device 652, a second user input device 654, and a third user input device 656 are operatively coupled to system bus 602 by user interface adapter 650. The user input devices 652, 654, and 656 can be any of a keyboard, a mouse, a keypad, an image capture device, a motion sensing device, a microphone, a device incorporating the functionality of at least two of the preceding devices, and so forth. Of course, other types of input devices can also be used, while maintaining the spirit of the present principles. The user input devices 652, 654, and 656 can be the same type of user input device or different types of user input devices. The user input devices 652, 654, and 656 are used to input and output information to and from system 600.

Of course, the processing system 600 may also include other elements (not shown), as readily contemplated by one of skill in the art, as well as omit certain elements. For example, various other input devices and/or output devices can be included in processing system 600, depending upon the particular implementation of the same, as readily understood by one of ordinary skill in the art. For example, various types of wireless and/or wired input and/or output devices can be used. Moreover, additional processors, controllers, memories, and so forth, in various configurations can also be utilized as readily appreciated by one of ordinary skill in the art. These and other variations of the processing system 600 are readily contemplated by one of ordinary skill in the art given the teachings of the present principles provided herein.

Figure 7:
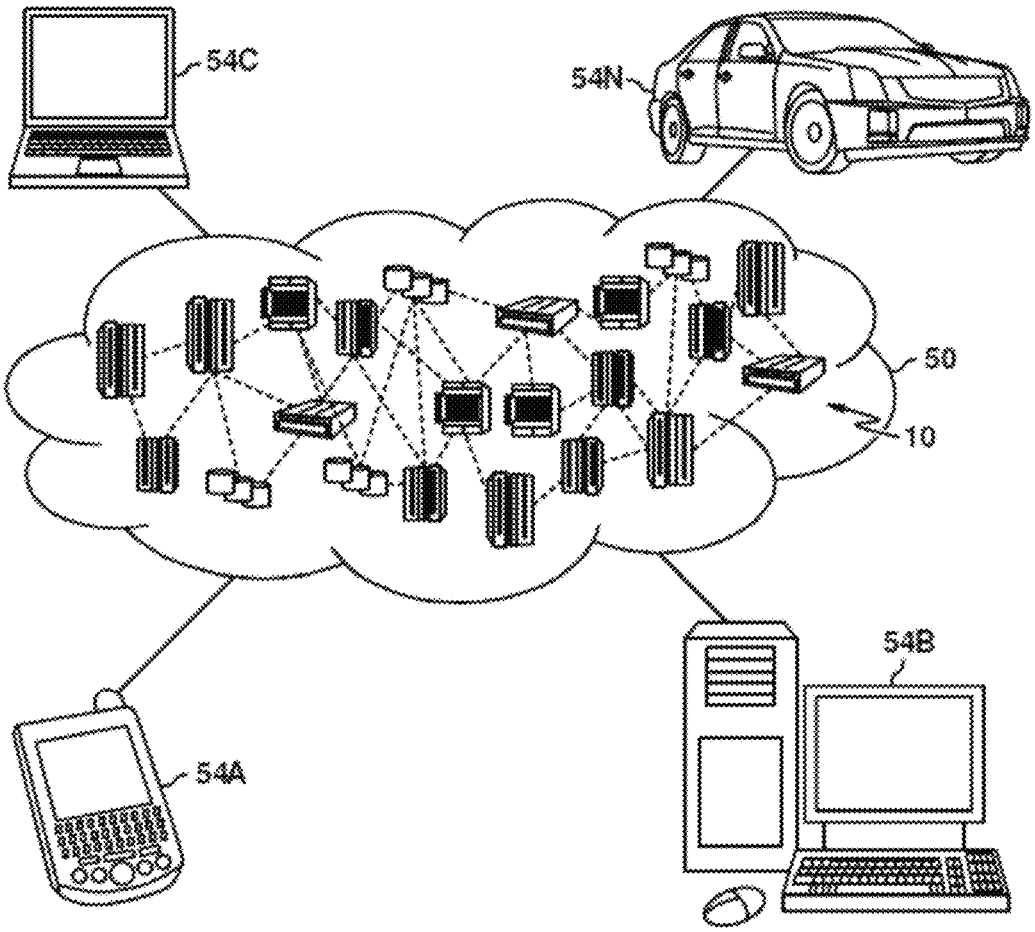
FIG. 7 is a diagram of a cloud computing environment according to the present principles.

Referring now to FIG. 7, illustrative cloud computing environment 50 is depicted. As shown, cloud computing environment 50 comprises one or more cloud computing nodes 10 with which local computing devices used by cloud consumers, such as, for example, personal digital assistant (PDA) or cellular telephone 54A, desktop computer 54B, laptop computer 54C, and/or automobile computer system 54N may communicate. Nodes 10 may communicate with one another. They may be grouped (not shown) physically or virtually, in one or more networks, such as Private, Community, Public, or Hybrid clouds as described hereinabove, or a combination thereof. This allows cloud computing environment 50 to offer infrastructure, platforms and/or software as services for which a cloud consumer does not need to maintain resources on a local computing device. It is understood that the types of computing devices 54A-N shown in FIG. 6 are intended to be illustrative only and that computing nodes 10 and cloud computing environment 50 can communicate with any type of computerized device over any type of network and/or network addressable connection (e.g., using a web browser).

Figure 8:
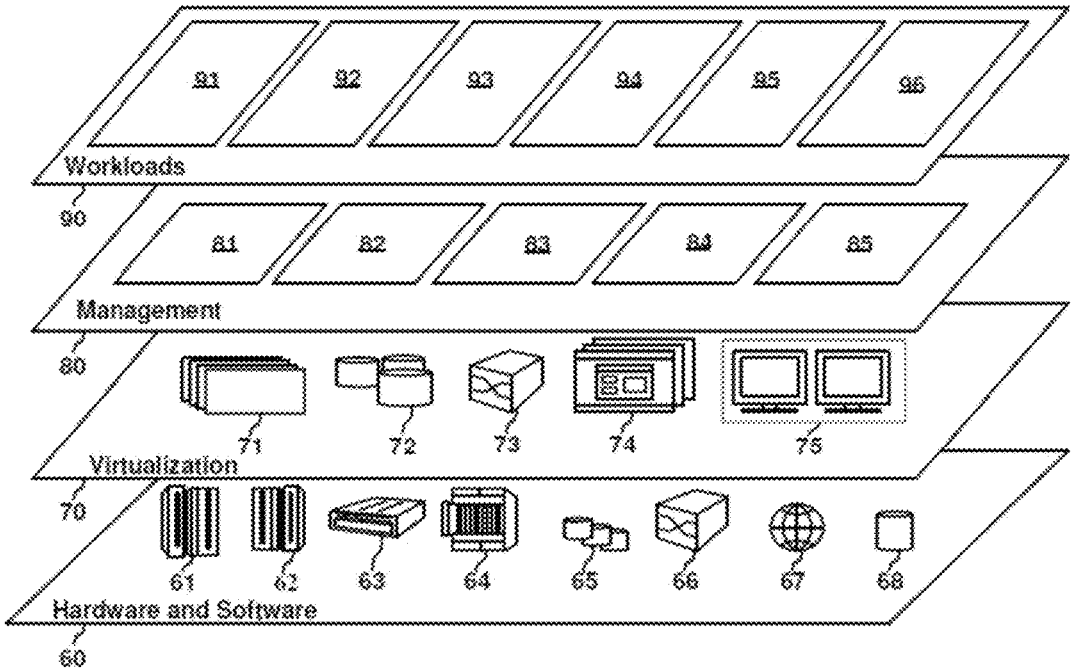
FIG. 8 is a diagram of abstraction model layers according to the present principles.

Referring now to FIG. 8, a set of functional abstraction layers provided by cloud computing environment 50 (FIG. 7) is shown. It should be understood in advance that the components, layers, and functions shown in FIG. 7 are intended to be illustrative only and embodiments of the invention are not limited thereto. As depicted, the following layers and corresponding functions are provided:

Hardware and software layer 60 includes hardware and software components. Examples of hardware components include: mainframes 61; RISC (Reduced Instruction Set Computer) architecture based servers 62; servers 63; blade servers 64; storage devices 65; and networks and networking components 66. In some embodiments, software components include network application server software 67 and database software 68.

Virtualization layer 70 provides an abstraction layer from which the following examples of virtual entities may be provided: virtual servers 71; virtual storage 72; virtual networks 73, including virtual private networks; virtual applications and operating systems 74; and virtual clients 75.

In one example, management layer 80 may provide the functions described below. Resource provisioning 81 provides dynamic procurement of computing resources and other resources that are utilized to perform tasks within the cloud computing environment. Metering and Pricing 82 provide cost tracking as resources are utilized within the cloud computing environment, and billing or invoicing for consumption of these resources. In one example, these resources may comprise application software licenses. Security provides identity verification for cloud consumers and tasks, as well as protection for data and other resources. User portal 83 provides access to the cloud computing environment for consumers and system administrators. Service level management 84 provides cloud computing resource allocation and management such that required service levels are met. Service Level Agreement (SLA) planning and fulfillment 85 provide pre-arrangement for, and procurement of, cloud computing resources for which a future requirement is anticipated in accordance with an SLA.

Workloads layer 90 provides examples of functionality for which the cloud computing environment may be utilized. Examples of workloads and functions which may be provided from this layer include: mapping and navigation 91; software development and lifecycle management 92; virtual classroom education delivery 93; data analytics processing 94; transaction processing 95; and context sensing and monitoring 96.

Having described preferred embodiments of energy-efficient audio life logging (which are intended to be illustrative and not limiting), it is noted that modifications and variations can be made by persons skilled in the art in light of the above teachings. It is therefore to be understood that changes may be made in the particular embodiments disclosed which are within the scope of the invention as outlined by the appended claims. Having thus described aspects of the invention, with the details and particularity required by the patent laws, what is claimed and desired protected by Letters Patent is set forth in the appended claims.

What is claimed is:

1. A method for controlling a plurality of sensors, comprising:

determining whether each of a plurality of sensors is stationary;

analyzing a plurality of streams of sensor data from respective stationary sensors using a processor to determine if multiple streams from the plurality of streams share a context; and deactivating all but one sensor associated with the multiple streams to conserve battery power across the sensors.

2. The method of claim 1, further comprising determining a location of each of the respective sensors.

3. The method of claim 2, wherein analyzing the plurality of streams comprises determining that multiple sensors share a location.

4. The method of claim 1, further comprising periodically repeating the analyzing and deactivating steps.

5. The method of claim 1, further comprising periodically deactivating the one sensor and reactivating another sensor in the shared context.

6. The method of claim 1, wherein analyzing the plurality of streams comprises determining whether the sensor data from the respective sensors reflects the same recorded information.

7. The method of claim 6, wherein analyzing the plurality of streams further comprises determining that the respective sensors do not share a context if a number of streams reflecting the same recorded information exceeds a threshold.

8. A non-transitory computer readable storage medium comprising a computer readable program for controlling a plurality of sensors, wherein the computer readable program when executed on a computer causes the computer to perform the steps of:

determining whether each of a plurality of sensors is stationary;

analyzing a plurality of streams of sensor data from respective stationary sensors using a processor to determine if multiple streams from the plurality of streams share a context; and deactivating all but one sensor associated with the multiple streams to conserve battery power across the sensors.

9. A system for controlling a plurality of sensors, comprising:

a context module comprising a processor configured determine whether each of a plurality of sensors is stationary and to analyze a plurality of streams of sensor data from respective stationary sensors using a processor to determine if multiple streams from the plurality of streams share a context; and a sensor control module configured to deactivate all but one sensor associated with the multiple streams to conserve battery power across the sensors.

10. The system of claim 9, further wherein the context module is further configured to determine a location of each of the respective sensors.

11. The system of claim 10, wherein the context module is further configured to determine that multiple sensors share a location.

12. The system of claim 9, wherein the context module and the sensor control module are further configured to repeat their respective analysis and deactivation functions.

13. The system of claim 9, wherein the sensor control module is further configured to periodically deactivate the one sensor and reactivating another sensor in the shared context.

14. The system of claim 9, wherein the context module comprises a media analysis module configured to determine whether the sensor data from the respective sensors reflects the same recorded information.

15. The system of claim 14, wherein the context module is further configured to determine that the respective sensors do not share a context if a number of streams reflecting the same recorded information exceeds a threshold.

* * * * *